US008222881B2

(12) United States Patent
Ivanov et al.

(10) Patent No.: US 8,222,881 B2
(45) Date of Patent: Jul. 17, 2012

(54) LOW-POWER FEEDBACK AND METHOD FOR DC-DC CONVERTERS AND VOLTAGE REGULATORS FOR ENERGY HARVESTERS

(75) Inventors: Vadim V. Ivanov, Tucson, AZ (US); Timothy V. Kaithoff, Tucson, AZ (US)

(73) Assignee: Texas Instruments Incorporated, Dallas, TX (US)

( * ) Notice: Subject to any disclaimer, the term of this patent is extended or adjusted under 35 U.S.C. 154(b) by 365 days.

(21) Appl. No.: 12/657,543

(22) Filed: Jan. 22, 2010

(65) Prior Publication Data

US 2011/0181258 A1 Jul. 28, 2011

(51) Int. Cl.
*G05F 1/00* (2006.01)

(52) U.S. Cl. ..... 323/288; 323/282

(58) Field of Classification Search ..... 323/288, 323/293, 283, 282
See application file for complete search history.

(56) References Cited

U.S. PATENT DOCUMENTS 6,281,665 B1 * 8/2001 Miyaba et al. ..... 323/224
6,411,531 B1 6/2002 Nork et al.
6,438,005 B1 8/2002 Walter
6,750,642 B2 * 6/2004 Murakata et al. ..... 323/323
2001/0028570 A1 10/2001 Mullett et al.
2006/0176037 A1 8/2006 Flatness et al.

OTHER PUBLICATIONS

PCT Search Report.

* cited by examiner

*Primary Examiner* — Shawn Riley
(74) *Attorney, Agent, or Firm* — John J. Patti; Wade J. Brady, III; Frederick J. Telecky, Jr.

(57) ABSTRACT

A converter (10) for converting a first DC voltage ($V_{DD}$) to a second DC voltage ($V_{OUT}$) includes an output stage (40) for producing the second DC voltage ($V_{OUT}$) in response to both the first DC voltage ($V_{DD}$) and an output of an error amplifier (20). A sampling circuit (15) periodically energizes a voltage divider (R0,R1) by periodically coupling a first terminal thereof to the second DC voltage and periodically coupling an output (14) of the energized voltage divider to a feedback conductor (7) to refresh a feed back capacitor (C0) coupled between the second DC voltage and the feedback conductor. The feedback conductor is coupled to an input of the error amplifier.

20 Claims, 3 Drawing Sheets

LOW-POWER FEEDBACK AND METHOD FOR DC-DC CONVERTERS AND VOLTAGE REGULATORS FOR ENERGY HARVESTERS

BACKGROUND OF THE INVENTION

The present invention relates generally to DC-DC converters and voltage regulators, and more particularly to very low power implementations thereof that are especially adapted for use in conjunction with energy harvesters.

FIG. 1 shows a conventional DC-DC converter or LDO (low drop out) voltage regulator 1 including a voltage reference circuit 3 which applies a reference voltage $V_{REF}$ to the (−) input of an error amplifier 2. Voltage reference 3 typically is a 1.2 volt bandgap circuit. Output 2A of error amplifier 2 is connected to the input of an output stage 4. Output stage 4 produces an output voltage $V_{OUT}$ on conductor 5, which is connected to one terminal of a load 6. The other terminal of load 6 is connected to ground. A resistive voltage divider circuit including series-connected resistors R0 and R1 is connected between $V_{OUT}$ and ground. The junction between resistors R0 and R1 is coupled by conductor 7 to the (+) input of error amplifier 2. Error amplifier 2 and output stage 4 are coupled between $V_{DD}$ and ground.

The voltage regulation loop of DC-DC converter or LDO voltage regulator 1 includes output stage 4, error amplifier 2, voltage reference 3, and resistive voltage divider R0,R1. Resistive voltage divider R0,R1 sets the desired value of the DC output voltage $V_{OUT}$ and allows the value of $V_{OUT}$ to be set to a level below, equal to, or above $V_{REF}$. Resistors R0 and R1 usually are external resistors mounted on a printed circuit board along with an integrated circuit chip including the other components of DC-DC converter 1. External resistors R0 and R1 typically have values of no more than about 1 to 2 megohms, because of leakage currents in the printed circuit board. If resistors R0 and R1 are formed on the integrated circuit chip, then they are expensive because of the large amount of chip area occupied by them. In either case, the power dissipation in the feedback resistor network R0,R1 is dominant if very low-power circuitry that is commonly referred to as "nano-power" circuitry is used to implement error amplifier 2 and output stage 4 in extremely low-power applications such as energy harvester systems.

In low power applications, the typical several microampere current through resistor divider R0,R1 is a substantial or even major part of the overall current consumed by the DC-DC converter or LDO voltage regulator 1 and therefore substantially diminishes the efficiency of converter 1 at small load currents of a few microamperes or less.

By way of definition, the term "DC-DC converter" as used herein is intended to encompass various kinds of DC-DC converters such as boost converters, buck converters, and buck/boost converters, and also is intended to encompass LDO voltage regulators. Also by way of definition, the term "nano-power" as used herein is intended to encompass circuits and/or circuit components which draw DC current of less than approximately 1 microampere.

Various low-power error amplifier configurations are known, and subsequently described Prior Art FIG. 6 shows a known low power error amplifier.

Thus, there is an unmet need to provide a way of substantially reducing the current and power consumption of a DC-DC converter.

There also is an unmet need for a DC-DC converter of the kind having a voltage divider feedback network that consumes only a minute average amount of current and power.

There also is an unmet need for a DC-DC converter of the kind having a voltage divider feedback network that consumes less than approximately 5 microamperes of current.

SUMMARY OF THE INVENTION

It is an object of the invention to provide a way of substantially reducing the current and power consumption of a DC-DC converter.

It is another object of the invention to provide a DC-DC converter of the kind having a voltage divider feedback network that consumes only a minute average amount of current and power.

It is another object of the invention to provide a DC-DC converter of the kind having a voltage divider feedback network that consumes an average current of less than approximately 100 nanoamperes of current.

Briefly described, and in accordance with one embodiment, the present invention provides a converter (10) for converting a first DC voltage ($V_{DD}$) to a second DC voltage ($V_{OUT}$) includes an output stage (40) for producing the second DC voltage ($V_{OUT}$) in response to both the first DC voltage ($V_{DD}$) and an output of an error amplifier (20). A sampling circuit (15) periodically energizes a voltage divider (R0,R1) by periodically coupling a first terminal thereof to the second DC voltage and periodically couples an output (14) of the energized voltage divider to a feedback conductor (7) to refresh a first capacitor (C0) coupled between the second DC voltage and the feedback conductor. The feedback conductor (7) is coupled to an input of the error amplifier. The converter (10) is especially useful in nano-power energy harvester applications.

In one embodiment, the invention provides a DC to DC conversion circuit for converting a first DC voltage ($V_{DD}$) to a second DC voltage ($V_{OUT}$), including an error amplifier (20) having a first input (−) coupled to receive a first reference voltage ($V_{REF}$) and an output stage (40) for producing the second DC voltage ($V_{OUT}$) on an output conductor (5). The output stage (40) has a first input coupled to an output (2A) of the error amplifier (20) and a second input coupled receive the first DC voltage ($V_{DD}$). A first capacitor (C0) has a first terminal coupled to the output conductor (5) and a second terminal coupled by a feedback conductor (7) to a second input (+) of the error amplifier (20). A voltage divider (R0,R1) has a first terminal coupled to a second reference voltage (GND). A sampling circuit (15) includes a first sampling switch (S0) having a first terminal coupled to a second terminal of the voltage divider (R0,R1) and a second terminal coupled to the output conductor (5), and a second sampling switch (S1) having a first terminal coupled to the feedback conductor (7) and a second terminal coupled to an output (14) of the voltage divider (R0,R1). A timing circuit (11) has a first output (12) coupled to a control terminal of the first sampling switch (S0) to periodically energize the voltage divider (R0, R1) and a second output (13) coupled to a control terminal of the second sampling switch (S1) to periodically refresh the first capacitor (C0) while the voltage divider (R0,R1) is energized, so as to reduce average power consumption in the voltage divider. In a described embodiment, a second capacitor (C1) is coupled between the feedback conductor (7) and the second reference voltage (GND). In a described embodiment, the voltage divider includes a first resistor (R0) having a first terminal coupled to the first terminal of the first sampling switch (S0) and a second terminal coupled to the output (14) of the voltage divider, and a second resistor (R1) having a first terminal coupled to the output (14) of the voltage divider and a second terminal coupled to the second reference voltage (GND). The second capacitor (C1) has a capacitance equal to a capacitance (C0) of the first capacitor multiplied by the ratio of a resistance (R0) of the first resistor divided by a resistance (R1) of the second resistor.

In one embodiment, the first sampling switch (S0) includes a first transistor (M0), wherein the first, second, and control terminals of the first sampling switch (S0) are first and second current carrying electrodes and a control electrode, respectively, of the first transistor (M0), and wherein the second sampling switch (S1) includes a second transistor (M1), wherein the first, second, and control terminals of the second sampling switch (S1) are first and second current carrying electrodes and a control electrode, respectively, of the second transistor (M1).

In one embodiment, the output stage (40) includes low drop out voltage regulator circuitry. In another embodiment, the output stage (40) includes a buck/boost converter (22) having an input coupled to the first DC voltage ($V_{DD}$), a control input coupled to the output (2A) of the error amplifier (20), and an output coupled to the output conductor (5). In one embodiment, the output stage (40) includes a transistor (M2 in FIG. 5A) having a source coupled to the first DC voltage ($V_{DD}$), a gate coupled to the output (2A) of the error amplifier (20), and a drain coupled to the output conductor (5). In the described embodiments, the first DC voltage ($V_{DD}$) is a harvested voltage from an energy harvesting device.

In one embodiment, the timing circuit (11) energizes the voltage divider (R0,R1) for at least an amount of time sufficient to allow the first capacitor (C0) to recover charge loss due to parasitic leakage current while the second switch (S1) is open. In one embodiment, the timing circuit (11) energizes the voltage divider (R0,R1) at least approximately once per second.

In one embodiment, the timing circuit (11) includes an oscillator (17) coupled to drive a frequency divider (18) and a decode circuit (20) for decoding various outputs of the frequency divider (18) so as to generate signals on the first (12) and second (13) outputs of the timing circuit (11). In one embodiment, the error amplifier (20) is a transconductance amplifier.

In one embodiment, the invention provides a method for decreasing power consumption of a converter (10) for converting a first DC voltage ($V_{DD}$) to a second DC voltage ($V_{OUT}$) including coupling a first input (−) of an error amplifier (20) of the converter (10) to receive a first reference voltage ($V_{REF}$) and coupling an output (2A) of the error amplifier (20) to an input of an output stage (40) of the converter (10), the converter (10) having a second input coupled receive the first DC voltage ($V_{DD}$), to produce the second DC voltage ($V_{OUT}$) on an output (5) of the converter (10); and periodically energizing a voltage divider (R0,R1) by periodically coupling a first terminal thereof to the second DC voltage ($V_{OUT}$) and periodically coupling an output (14) of the energized voltage divider (R0,R1) to refresh a first capacitor (C0) coupled between the second DC voltage ($V_{OUT}$) and a feedback conductor (7) coupled to a second input (+) of the error amplifier (20). In one embodiment, this includes periodically closing a first sampling switch (S0) to energize the voltage divider (R0,R1) from the output conductor (5) and closing a second sampling switch (S1) to couple the output (14) of the energized voltage divider (R0,R1) to the feedback conductor (7) for a sufficient amount of time to ensure that the voltage across the first capacitor (C0) has recovered from any parasitic leakage of charge from the first capacitor (C0) that may occur while the voltage divider (R0,R1) is not energized.

In one embodiment, the method includes ensuring stability of the error amplifier (20) by coupling a second capacitor (C1) between the feedback conductor (7) and the second reference voltage (GND) such that the first (C0) and second (C1) capacitors function as a voltage divider having a division ratio equal to a division ratio of the voltage divider (R0,R1).

In one embodiment, the invention provides circuitry for decreasing power consumption of a converter (10) for converting a first DC voltage ($V_{DD}$) to a second DC voltage ($V_{OUT}$), including means (40) for producing the second DC voltage ($V_{OUT}$) on an output (5) of the converter (10) in response to an output of an error amplifier (20) and in response to the first DC voltage ($V_{DD}$); and means (15) for periodically energizing a voltage divider (R0,R1) by periodically coupling a first terminal thereof to the second DC voltage ($V_{OUT}$) by coupling an output (14) of the energized voltage divider (R0,R1) to a feedback conductor (7) to refresh a first capacitor (C0) coupled between the second DC voltage ($V_{OUT}$) and the feedback conductor (7), the feedback conductor (7) being coupled to an input of the error amplifier (20).

A DETAILED DESCRIPTION OF THE PREFERRED EMBODIMENTS

Figure 1:
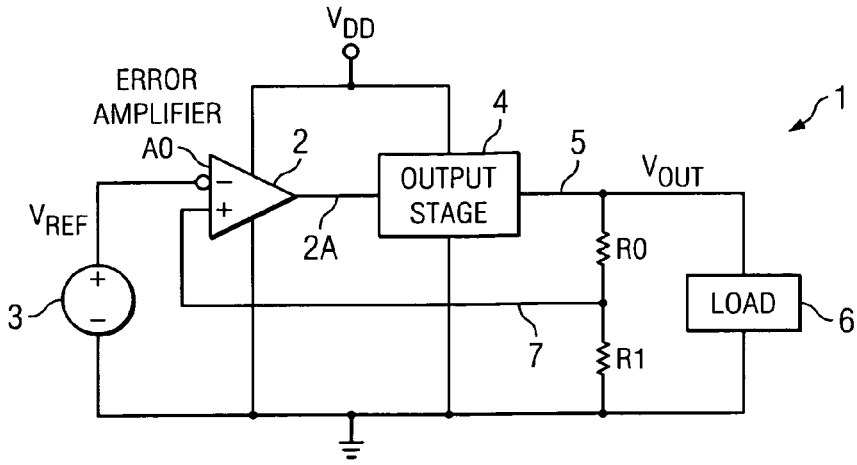
FIG. 1 (PRIOR ART)
FIG. 1 is a schematic drawing of a conventional DC-DC converter or LDO voltage regulator.
Figure 2:
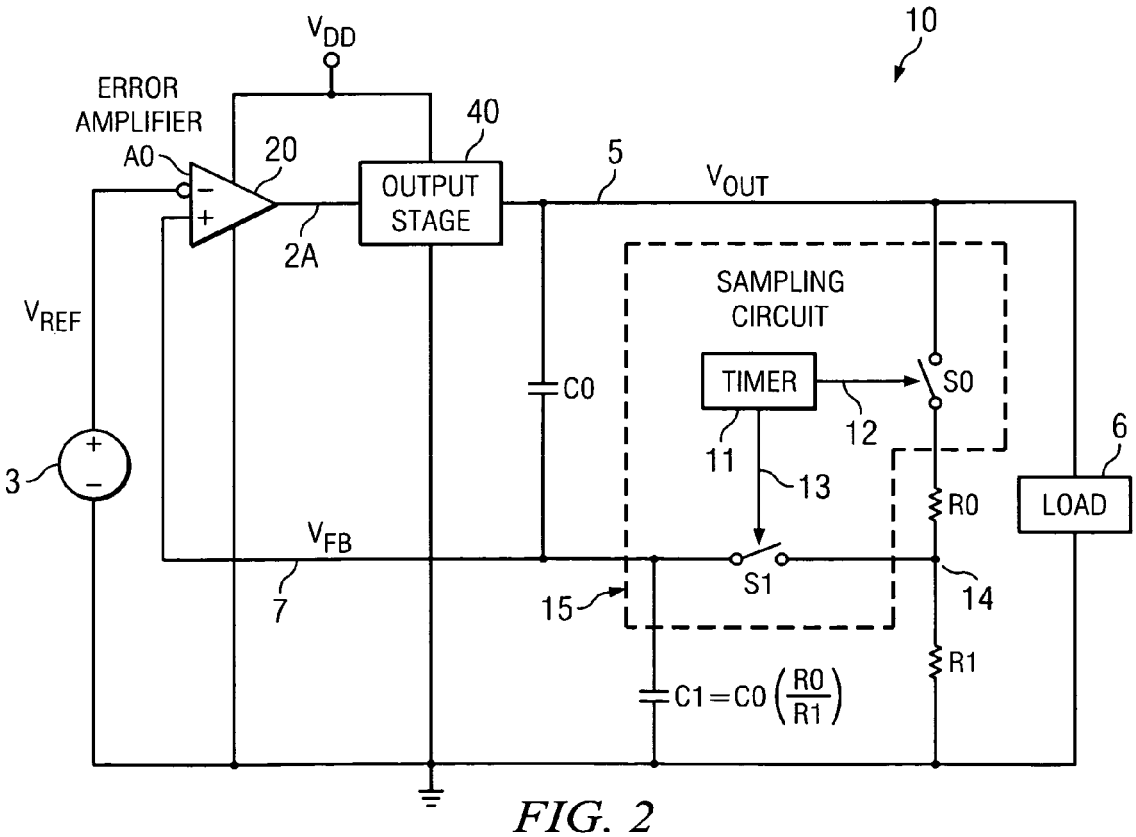
FIG. 2 is a schematic diagram of a very low power implementation of the DC-DC converter or LDO voltage regulator of FIG. 1.

In accordance with the present invention, the problem of high power consumption in the converter 1 of Prior Art FIG. 1 is solved by removing resistive voltage divider R0,R1 from the feedback loop of converter 1 and instead providing either a feedback capacitor C0 alone or by providing capacitive feedback voltage divider C0,C1 as shown in DC-DC converter 10 of FIG. 2. The resistive voltage divider R0,R1 is periodically energized to substantially reduce its average power consumption, and an output of the energized resistive voltage divider R0,R1 is sampled long enough to refresh the feedback capacitor C0 or capacitive feedback voltage divider C0,C1 by replacing any DC charge lost therefrom due to parasitic currents.

DC-DC converter 10 in FIG. 2 may be a conventional DC-DC converter or a LDO voltage regulator, and includes a nano-power voltage reference circuit 3 which applies a reference voltage $V_{REF}$ to the (−) input of a nano-power error amplifier 20. Various very low-power, i.e., nano-power, known implementations of bandgap reference circuit (for which $V_{REF}$ which is approximately 1.2 volts) or a reverse bandgap reference circuit (for which $V_{REF}$ is approximately 200 millivolts) can be used. The output 2A of error amplifier 20 is connected to the input of a nano-power output stage 40. Output stage 40 produces output voltage $V_{OUT}$ on conductor 5, which is connected to one terminal of load 6. The other terminal of load 6 is connected to ground. Various implementations of error amplifier 20 may be used, such as the one shown in Prior Art FIG. 6.

Feedback capacitor C0 is coupled between output conductor 5 and feedback conductor 7. An optional capacitor C1 is connected between feedback conductor 7 and ground so that capacitors C0 and C1 form a capacitive feedback voltage divider between $V_{OUT}$ and the (+) input of error amplifier 20. Error amplifier 20 and output stage 40 are coupled between $V_{DD}$ and ground. A resistive voltage divider circuit including series-connected resistors R0 and R1 has one terminal connected to ground and another terminal coupled to a first terminal of a first sampling switch S0. Sampling switch S0 has a second terminal coupled to $V_{OUT}$ and a control terminal coupled by conductor 12 to the output of a timing circuit 11. The junction 14 between resistors R0 and R1 is the output of resistive divider R0,R1 and is coupled to a first terminal of a second sampling switch S1 having a second terminal connected to feedback conductor 7. The control terminal of sampling switch S1 is coupled by conductor 13 to another output of timing circuit 11. Feedback conductor 7 is coupled to the (+) input of error amplifier 20. Sampling switches S0 and S1 and timing circuit 11 are included in a sampling circuit 15. If capacitor C1 is utilized, it preferably has a capacitance equal to C0×(R0/R1).

In accordance with the present invention, resistive divider R0,R1 is periodically energized from $V_{OUT}$ through sampling switch S0, which is controlled by a first sampling signal generated on conductor 12 by timing circuit 11. During essentially that same time interval, the amount of DC charge in feedback capacitor C0 is periodically refreshed from output conductor 14 of resistive voltage divider R0,R1 through sampling switch S1 in response to a second sampling signal generated on conductor 13 by timing circuit 11. This periodic refreshing of feedback capacitor C0 is necessary because parasitic leakage currents may significantly diminish the voltage across feedback capacitor C0. The refresh interval during which sampling switch S1 is on typically would be a few microseconds and must occur at least approximately every second by turning on sampling switch S0 while resistive voltage divider R0,R1 is energized. Timing circuit 11 determines the duration and period of each energizing of resistive voltage divider R0,R1 and the duration of each sampling of the output voltage on conductor 14 of the energized resistive divider R0,R1.

If optional capacitor C1 is utilized, then capacitive divider C0,C1 performs essentially the same feedback function as resistive divider R0,R1 in Prior Art FIG. 1, and further helps ensure stability of error amplifier 20 in FIG. 2.

Since there is no constant DC current through resistive voltage divider S0,S1, the overall current and power consumption of divider S0,S1, and hence also the overall current and power consumption of DC-DC converter 10, are greatly reduced compared to that of converter 1 in Prior Art FIG. 1.

To summarize, the invention replaces the power-consuming resistive feedback network of Prior Art FIG. 1 with a capacitive feedback circuit that is periodically refreshed by sampling a periodically energized resistive divider circuit, as shown in FIG. 2. In a simple implementation, a voltage is sampled across the capacitor C0 from the output 14 of resistive voltage divider network R0,R1 via switch S1 and feedback conductor 7. Capacitor C0 stores a voltage equal to the difference between reference voltage $V_{REF}$ and Vout. In another implementation, an advantage to using both of capacitors C1 and C0 is that it provides error amplifier 20 with a gain of roughly 2 rather than the unity gain that occurs if only feedback capacitor C0 is used. This results in the above mentioned improved stability of error amplifier 20.

Figure 3:
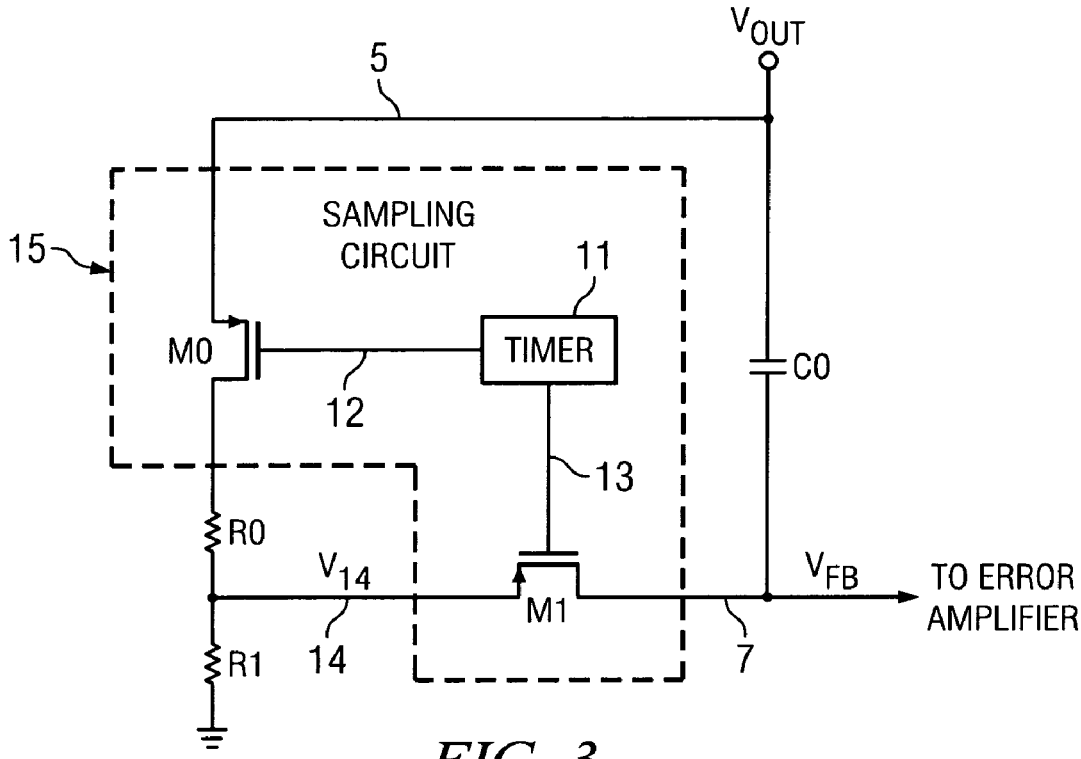
FIG. 3 includes a schematic diagram of circuit 15 in FIG. 2.

FIG. 3 shows one implementation of sampling circuit 15, wherein timing circuit 11 of FIG. 2 applies "energize" pulses via conductor 12 to the gate of P-channel transistor M0, which is utilized as switch S0. The source of transistor M0 is connected to output conductor 5, and the drain of transistor M0 is connected to the upper terminal of divider resistors R0. The durations of the "energize" pulses on conductor 12 is sufficient to energize resistive divider R0,R1 at least long enough to allow refreshing of capacitor C0, and also of capacitor C1 if it is utilized. Timing circuit 11 also applies to "refresh" pulses via conductor 13 to the gate of P-channel transistor M1, which is utilized as switch S1, while resistive divider R0,R1 is energized. Each "refresh" pulse turns transistor M1 on for an amount of time sufficient to refresh feedback capacitor C0. The period of the pulses on conductors 12 and 13 is at least long enough to ensure that parasitic currents do not diminish the voltage across feedback capacitor C0 more than a predetermined amount.

Figure 4:
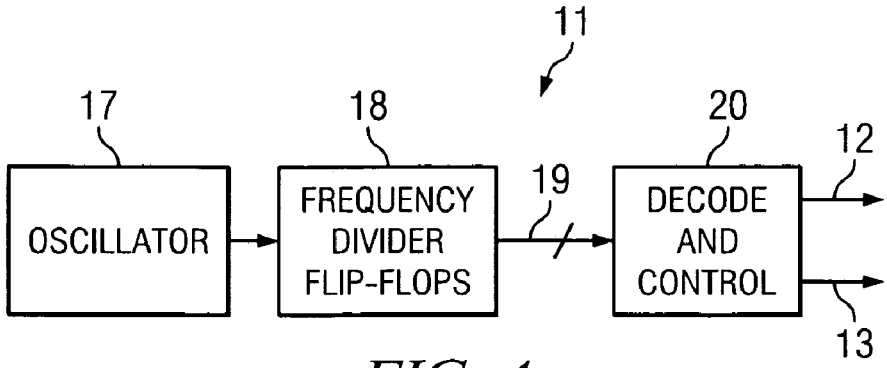
FIG. 4 (PRIOR ART)
FIG. 4 is a block diagram of a conventional implementation of timing circuit 11 in FIGS. 2 and 3.

Prior Art FIG. 4 shows a conventional implementation of timer 11 in FIG. 2, including a conventional clock oscillator 17, the output of which derives a conventional frequency divider 18 including a chain of flip-flops. Various taps 19 of frequency divider 18 are decoded by decode and control circuit 20 to generate the above described switch control signals on conductors 12 and 13.

Figure 5A:
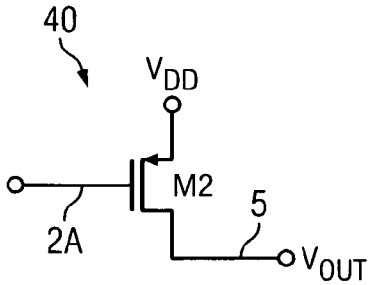
FIG. 5A (PRIOR ART)
FIG. 5A is a block diagram of one implementation of output circuit 40 in FIG. 2.
Figure 5B:
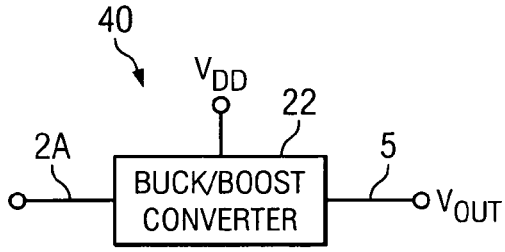
FIG. 5B (PRIOR ART)
FIG. 5B is a block diagram of another implementation of output circuit 40 in FIG. 2.

Prior Art FIGS. 5A and 5B show two implementations of output circuit 40 in FIG. 2. Output circuit 40 as shown in FIG. 5A includes a P-channel transistor M2 having its source coupled to $V_{DD}$, its gate connected to the output 2A of error amplifier 20, and its drain connected to $V_{OUT}$ conductor 5. Output circuit 40 as shown in FIG. 5B includes a conventional buck/boost converter 22 having its input terminal coupled to $V_{DD}$, its control input coupled to output 2A of error amplifier 20, and its output connected to $V_{OUT}$ conductor 5.

Figure 6:
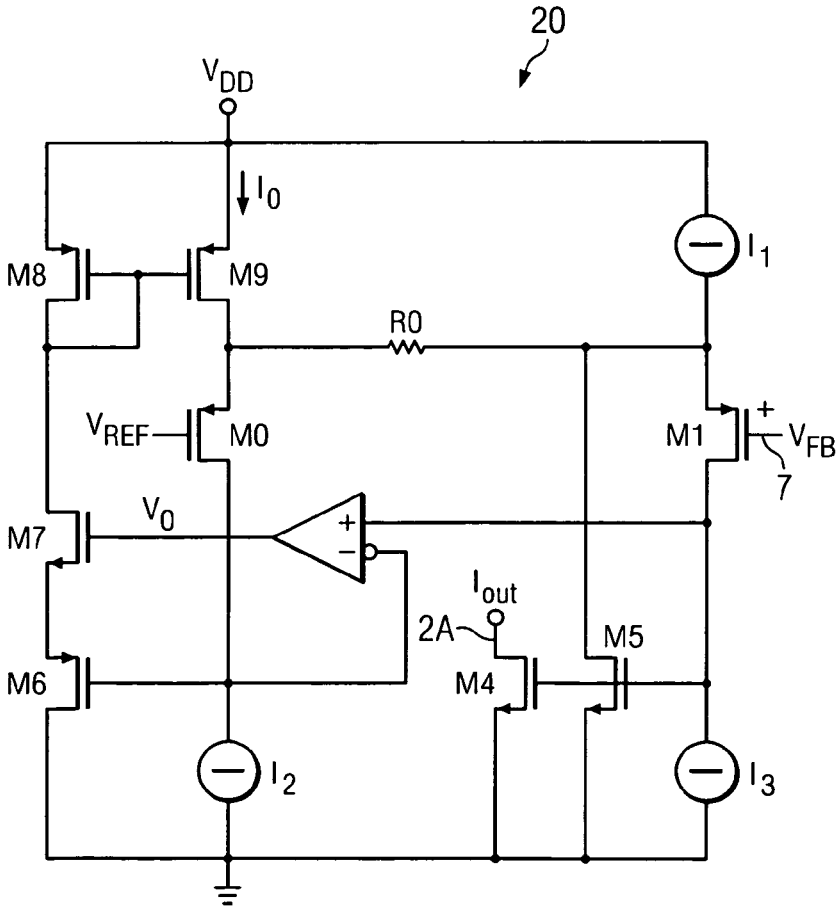
FIG. 6 (PRIOR ART)
FIG. 6 is a schematic diagram of a very low power implementation of error amplifier 20 in FIG. 2.

Prior Art FIG. 6 shows an implementation of previously mentioned low power error amplifier 20 in FIG. 2. Error amplifier 20 as shown in FIG. 6 is implemented as a nano-power class AB transconductance error amplifier. It should be appreciated that one of the most important parameters of a low power or nano-power DC-DC converter is its no-load quiescent current, which usually is dominated by the error amplifier therein. The bandwidth of the error amplifier needs to be larger than the bandwidth of the DC-DC converter, and is roughly proportional to the quiescent current of the error amplifier. The gain of the error amplifier determines the frequency stability of the DC-DC converter and should be kept stable within 5 to 10%. The offset of the error amplifier determines the accuracy of the DC-DC converter and should be as low as possible, ideally below 1 millivolt. In error amplifier 20 as shown in FIG. 6, the currents of transistors M0 and M1 are equal to the currents I2 and I3, respectively, as long as there is a gain greater than 1 in the feedback loop including transistors M0 and M1 in FIG. 6 and the feedback loop including transistors M1 and M5. As a result, difference of the currents in transistors M2 and M4, mirrored by transistors M3 and M4 in FIG. 6, is $dIout=d(V_{FB}-Vin)/R0$.

In this circuit the current through transistor M0 is equal to I2, which makes the gate-source voltage $V_{GS0}$ of transistor M0 equal to the gate-source voltage $V_{GS1}$ of transistor M1 and $dIout=d(V_{FB}-Vin)/R0$. The current I1 should be equal to I3, and the current I0 is delivered by feedback loop M6-M7-M8-M9, just enough to keep the circuit operational and provide the current through transistor M4 and the current through transistor M5 both equal to the current Iout produced by error amplifier 20 in conductor 2A. When the input differential voltage is zero, the quiescent current Iq of error amplifier 20 is approximately equal to I2+I3. The values of I2 and I3 determine the bandwidth of the feedback loops M1,M5 and M0-M6-M7-M8-M9 and should be chosen according to the required bandwidth of error amplifier 20. Simulations indicate that the quiescent current Iq is equal to approximately 1 microampere per 100 kHz of bandwidth for a CMOS manufacturing process having a 0.35 micron minimum channel length. The accuracy and offset of amplifier 20 is improved by keeping the drain voltages of transistors M0 and M1 in FIG. 6 equal.

Thus, the invention solves the above mentioned problem of the prior art by utilizing a capacitive feedback network that is periodically refreshed by sampling a voltage representative of the DC output voltage from a resistive voltage divider that itself is periodically energized. This substantially reduces the average current and power consumption of the resistive voltage divider and therefore allows a practical implementation of an extremely low power DC-DC converter that is useful in energy harvesting applications.

While the invention has been described with reference to several particular embodiments thereof, those skilled in the art will be able to make various modifications to the described embodiments of the invention without departing from its true spirit and scope. It is intended that all elements or steps which are insubstantially different from those recited in the claims but perform substantially the same functions, respectively, in substantially the same way to achieve the same result as what is claimed are within the scope of the invention. For example, it may be practical to replace the resistive voltage divider by a corresponding capacitive voltage divider in which each capacitor is periodically short-circuited to reset each capacitor of the capacitive voltage divider to zero volts just before energizing the capacitive divider. The output of the capacitive divider than could be used to periodically refresh C0. Or, the capacitors in the foregoing capacitive voltage divider can be coupled to a known voltage reference, such as a bandgap voltage reference, so that the voltage across each capacitor after it has been reset is a known value other than zero.

What is claimed is:

1. A DC to DC conversion circuit for converting a first DC voltage to a second DC voltage, comprising:

(a) an error amplifier having a first input coupled to receive a first reference voltage;

(b) an output stage for producing the second DC voltage on an output conductor, the output stage having a first input coupled to an output of the error amplifier and a second input coupled receive the first DC voltage;

(c) a first capacitor having a first terminal coupled to the output conductor and a second terminal coupled by a feedback conductor to a second input of the error amplifier;

(d) a voltage divider having a first terminal coupled to a second reference voltage; and (e) a sampling circuit including a first sampling switch having a first terminal coupled to a second terminal of the voltage divider and a second terminal coupled to the output conductor, a second sampling switch having a first terminal coupled to the feedback conductor and a second terminal coupled to an output of the voltage divider, and a timing circuit having a first output coupled to a control terminal of the first sampling switch to periodically energize the voltage divider and a second output coupled to a control terminal of the second sampling switch to periodically refresh the first capacitor while the voltage divider is energized, to reduce power consumption in the voltage divider.

2. The DC to DC conversion circuit of claim 1 including a second capacitor coupled between the feedback conductor and the second reference voltage.

3. The DC to DC conversion circuit of claim 2 wherein the voltage divider includes a first resistor having a first terminal coupled to the first terminal of the first sampling switch and a second terminal coupled to the output of the voltage divider, and a second resistor having a first terminal coupled to the output of the voltage divider and a second terminal coupled to the second reference voltage.

4. The DC to DC conversion circuit of claim 3 wherein the second capacitor has a capacitance equal to a capacitance of the first capacitor multiplied by the ratio of a resistance of the first resistor divided by a resistance of the second resistor.

5. The DC to DC conversion circuit of claim 1 wherein the first sampling switch includes a first transistor, wherein the first, second, and control terminals of the first sampling switch are first and second current carrying electrodes and a control electrode, respectively, of the first transistor, and wherein the second sampling switch includes a second transistor, wherein the first, second, and control terminals of the second sampling switch are first and second current carrying electrodes and a control electrode, respectively, of the second transistor.

6. The DC to DC conversion circuit of claim 1 including a nano-power voltage reference circuit for producing the first reference voltage.

7. The DC to DC conversion circuit of claim 1 wherein the error amplifier is a nano-power amplifier.

8. The DC to DC conversion circuit of claim 1 wherein the output stage includes a low drop out (LDO) voltage regulator.

9. The DC to DC conversion circuit of claim 1 wherein the output stage includes a buck/boost converter having an input coupled to the first DC voltage, a control input coupled to the output of the error amplifier, and an output coupled to the output conductor.

10. The DC to DC conversion circuit of claim 1 wherein the output stage includes a transistor having a source coupled to the first DC voltage, a gate coupled to the output of the error amplifier, and a drain coupled to the output conductor.

11. The DC to DC conversion circuit of claim 1 wherein the first DC voltage is a voltage signal harvested from an energy harvesting device.

12. The DC to DC conversion circuit of claim 1 wherein the timing circuit energizes the voltage divider at least approximately once per second.

13. The DC to DC conversion circuit of claim 11 wherein the timing circuit energizes the voltage divider for at least an amount of time sufficient to allow the first capacitor to recover charge loss due to parasitic leakage current while the second switch is open.

14. The DC to DC conversion circuit of claim 1 wherein the timing circuit includes an oscillator coupled to drive a frequency divider and a decode circuit for decoding various outputs of the frequency divider so as to generate signals on the first and second outputs of the timing circuit.

15. The DC to DC conversion circuit of claim 1 wherein the error amplifier is a transconductance amplifier.

16. A method for decreasing power consumption of a converter for converting a first DC voltage to a second DC voltage, comprising:

(a) coupling a first input of an error amplifier of the converter to receive a first reference voltage and coupling an output of the error amplifier to a first input of an output stage of the converter, the converter having a second input coupled receive the first DC voltage, to produce the second DC voltage on an output of the converter; and (b) periodically energizing a voltage divider by periodically coupling a first terminal thereof to the second DC voltage and periodically coupling an output of the energized voltage divider to refresh a first capacitor coupled between the second DC voltage and a feedback conductor coupled to a second input of the error amplifier.

17. The method of claim 16 wherein step (b) includes periodically closing a first sampling switch to energize the voltage divider from the output conductor and closing a second sampling switch to couple the output of the energized voltage divider to the feedback conductor for a sufficient amount of time to ensure that the voltage across the first capacitor has recovered from parasitic leakage of charge from the first capacitor while the voltage divider is not energized.

18. The method of claim 17 including providing nanopower implementations of the error amplifier and the output stage.

19. The method of claim 16 including ensuring stability of the error amplifier by coupling a second capacitor between the feedback conductor and the second reference voltage such that the first and second capacitors function as a voltage divider having a division ratio equal to a division ratio of the voltage divider.

20. Circuitry for decreasing power consumption of a converter for converting a first DC voltage to a second DC voltage, comprising:

(a) means for producing the second DC voltage on an output of the converter in response to an output of an error amplifier and in response to the first DC voltage; and (b) means for periodically energizing a voltage divider by periodically coupling a first terminal thereof to the second DC voltage by coupling an output of the energized voltage divider to a feedback conductor to refresh a first capacitor coupled between the second DC voltage and the feedback conductor, the feedback conductor being coupled to an input of the error amplifier.

* * * * *